US005694868A

United States Patent [19]

Mitthof

[11] Patent Number: 5,694,868

[45] Date of Patent: Dec. 9, 1997

[54] FURNACE SYSTEM WITH POST COMBUSTION SPACE

[75] Inventor: Hans Mitthof, Bad Mergentheim, Germany

[73] Assignee: Michard Kablitz & Mitthof GmbH, Germany

[21] Appl. No.: 668,344

[22] Filed: Jun. 26, 1996

[30] Foreign Application Priority Data

Jun. 29, 1995 [DE] Germany ..... 195 25 106.7

[51] Int. Cl.[6] ..... F23B 5/00

[52] U.S. Cl. ..... 110/210; 110/345; 110/259

[58] Field of Search ..... 110/264, 186, 110/216, 244, 245, 248, 255, 281, 346

[56] References Cited

U.S. PATENT DOCUMENTS 5,044,288 9/1991 Barlow ..... 110/345

5,279,234 1/1994 Bender et al. ..... 110/210

FOREIGN PATENT DOCUMENTS

| | | |
|---|---|---|
| 275 700 | of 0000 | Australia . |
| 0 445 070 | of 0000 | European Pat. Off. . |
| 0 525 711 | of 0000 | European Pat. Off. . |
| 1 176 781 | of 0000 | Germany . |
| 2359730 | of 0000 | Germany . |
| 4426357A1 | of 0000 | Germany . |

OTHER PUBLICATIONS

Advertising of Richard Kablitz & Mitthof GmbH re Reciprocating Grate.

*Primary Examiner*—Henry A. Bennett
*Assistant Examiner*—Pamela A. O'Connor
*Attorney, Agent, or Firm*—D. Peter Hochberg; Mark Kusner

[57] ABSTRACT

Furnace exhaust gases extremely low in harmful substances are achieved by means of a specially designed postcombustion space.

4 Claims, 1 Drawing Sheet

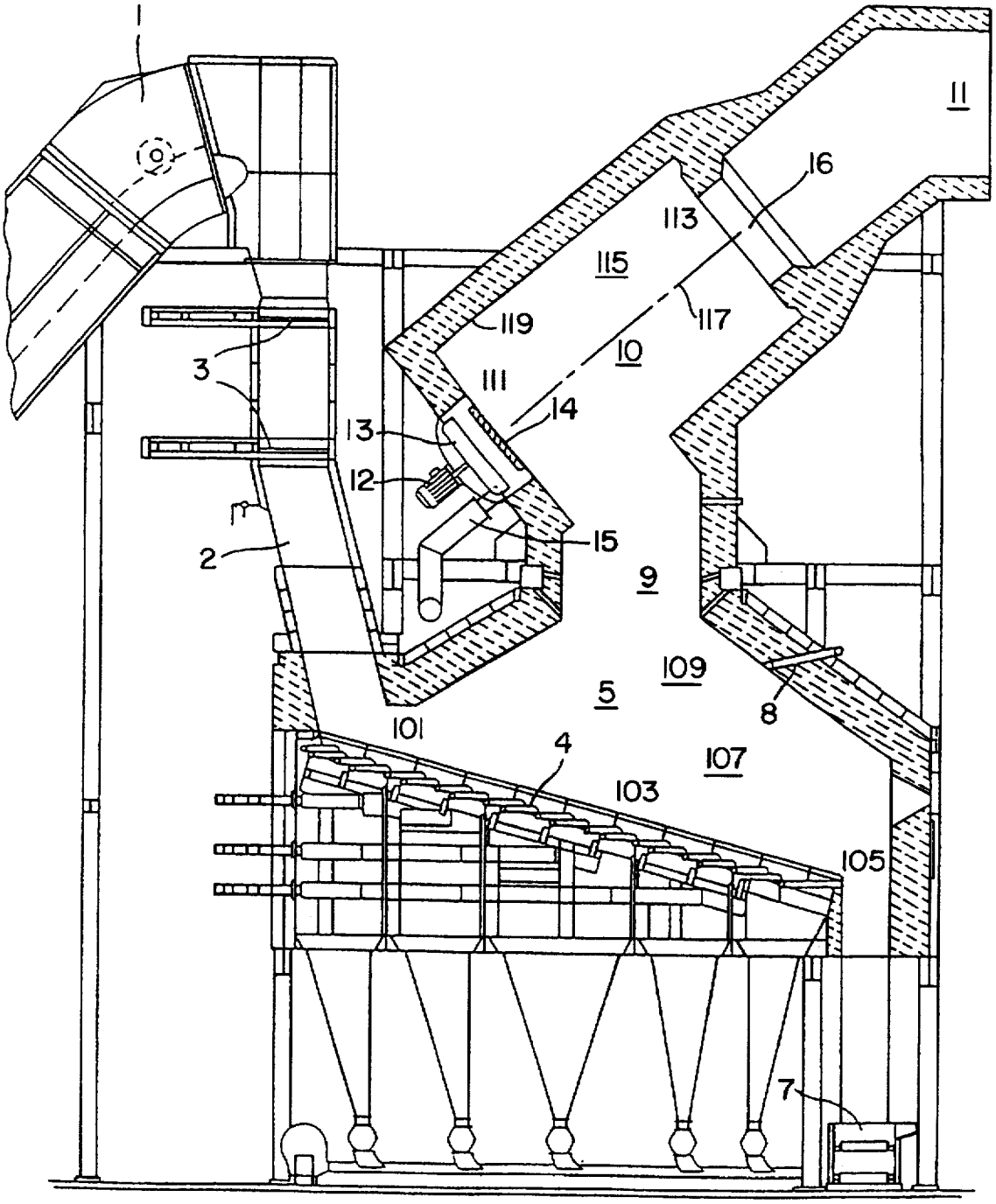
1
11
16
113
115
117
119
10
111
14
13
12
3
15
2
9
109
5
8
101
4
107
103
105
7

FURNACE SYSTEM WITH POST COMBUSTION SPACE

The invention relates to a furnace system for solid combustible material, especially for organic solid fuels, such as, for example, wood, wood waste, bark, biowaste, waste from the production of chipboards or the like, with a feed grate having a controllable underblast supply, said feed grate rearranging the combustible material continuously and guiding it through various zones, for example a drying, combustion and burnout zone, of a primary region of a furnace space, with a secondary region of the furnace space having an additional air supply, said secondary region being arranged above the primary region in the furnace space, and with an outlet of the furnace space, said outlet being arranged above the secondary region.

Furnace systems of this type are fundamentally known, see, for example, German Offenlegungsschrift 2359730 and DE 4426357 A1. The systems described in these publications are provided especially for the incineration of refuse or waste.

However, other combustible material can also be utilized in such like or similar systems. For example, wood chips, which occur in the woodworking industry, can be utilized as a combustible material. The feed grate is composed of a series of grate bar rows. The feed grate can possess fixed and moved grate bar rows arranged in a step-like manner, in order to achieve especially effective rearrangement of the combustible material and an optimum stoking effect. Furthermore, such a grate can work at a variable transport speed in the individual grate sections, in order to adapt the dwell time of the combustible material in the various zones of the primary region of the furnace space to the respective requirements or to the qualities of the combustible material.

In order to guarantee exhaust gases low in harmful substances, a cyclone combustion chamber can be provided according to German Offenlegungsschrift 2359730. According to DE 4126357 A1, a rotatable nozzle cylinder is arranged in the smoke offtake.

Despite the fact that the exhaust gases are low in harmful substances, however, a further reduction in the proportion of harmful substances is still desired.

The object of the invention is, therefore, to optimize furnace systems of the initially specified type in terms of lack of harmful substances.

This object is achieved, according to the invention, in that the outlet of the furnace space opens from below, preferably essentially radially, into a lower region of a postcombustion space designed as a swirl chamber and having a longitudinal axis inclined relative to a horizontal plane and an outlet arranged at the upper end of the longitudinal axis.

As a result of the oblique arrangement of the postcombustion space, the vertical movement component of the flow of combustion gases is markedly reduced in comparison with the mean flow velocity in the direction of the longitudinal axis of the postcombustion space, with the result that the mean rate of fall of entrained particles of combustible material in relation to the combustion gases becomes higher than their mean flow velocity in the vertical direction. Insofar as the particles of combustible material then fall onto the oblique walls of the postcombustion space before complete combustion, by virtue of the oblique arrangement they can slide back to the outlet of the secondary region of the furnace space, where they are intercepted once more by the flow of combustion gases and supplied again to the turbulent swirl of combustion gases which is constantly maintained in the postcombustion space.

Altogether, therefore, extremely long dwell times in the postcombustion space are achieved for poorly combustible residual particles of the fuel, the result of this being that complete burnout or complete gasification can be expected.

Since the combustion exhaust gases are therefore virtually free of dust, the further advantage is achieved that the heat exchangers, which are located downstream of the postcombustion space and which serve for utilizing the heat of the combustion gases, can become only slightly contaminated and therefore work at high efficiency.

Moreover, as regards advantageous features of the invention, reference is made to the claims and to the following explanation of the drawing, by means of which especially preferred embodiments of the invention are described.

In the drawing, the single FIGURE shows a diagrammatic sectional representation of a large furnace system according to the invention.

The furnace part, shown in the drawing, of a boiler plant possesses, inter alia, a fuel delivery 1 and a fall shaft 2 with hydraulically actuated flaps 3, so that combustible material can be guided onto a stepped feed grate 4 which leads from the fall shaft 2 in the downward direction and which forms the underside of a furnace space 5. The grate can be subjected underblast from below in a controlled manner, zonal underblast regulation being possible, in order to supply to the combustible material the quantity of combustion air which is required or desired in each case. By means of a hydraulically actuated frame system, the tubular bars can be pushed back and forth, in order to transport the combustible material, rearranged at the same time, in the direction of the lower end of the feed grate 4. The combustible material is thereby displaced through a drying zone 101 following the fall shaft and through a combustion zone 103 to a burnout zone 105 at the lower end of the feed grate 4, where the incombustible slag is then thrown onto a wet conveyor stage 7, to which ash falling down through the feed grate 4 is also supplied. If appropriate, these grate screenings can also be supplied pneumatically to the furnace space.

The furnace space 5 extends from a primary region 107 above the feed grate 4 via a secondary region 109, into which additional combustion air is blown through separate air inlets 8, to an outlet 9 which opens from below, essentially radially, into the lower region 111 of a postcombustion chamber 10 arranged with an oblique longitudinal axis. This postcombustion chamber 10 possesses an essentially cylindrical interior, to the upper end face 113 of which is connected an outlet conduit 11 leading to a heating boiler (not shown).

Arranged on the lower, essentially closed end face of the postcombustion chamber 10 is a blower assembly 13 which is driven by an electric motor 12 and by means of which it is possible to generate within the postcombustion chamber 10 a turbulent swirl flow in a swirl flow chamber 115 rotating about the longitudinal axis 117 of the latter. The blower assembly 13 can be a blower wheel or blade wheel driven by the electric motor 12, in which case the blade elements can be formed by members of chain parts which are each retained at one end on a hub driven by the electric motor 12 and the free ends of which are tensioned radially outward by centrifugal forces during the rotation of the hub. A heat shield 14 can be arranged on the side of the blower assembly 13 facing the postcombustion chamber 10, in order to protect the blower assembly 13 against direct heat radiation from the postcombustion chamber 10.

In the region of the blower assembly 13, a controllable air supply 15 opens into the postcombustion space 10, in order, on the one hand, to supply additional combustion air and, on the other hand, to afford the possibility of mixing this air rapidly with the combustion gases in the chamber 10.

The outlet 16 of the chamber 10 has a cross-section markedly reduced in relation to the chamber 10, so that the swirl flow generated by the blower assembly 13 has a larger movement component in the outlet direction solely in the region of its center adjacent to the chamber longitudinal axis.

By virtue of the swirl flow, particles in the postcombustion space 10 which are entrained by the combustion gases are largely kept away from the mid-axis of said postcombustion space and are transported into near-wall regions. Consequently, in practice, these particles cannot reach the outlet 16 of the postcombustion space 10. The same also applies analogously to particles in the region of the mid-axis of the postcombustion space 10. By virtue of the oblique arrangement of this space 10, the vertical component of the gas flow is relatively small in this region, so that the particles can fall downward into the region of the swirl flow.

Should the particles strike against the inner wall 119 of the space 10, they will slip at least partially downward to the outlet 9 of the furnace space 5 and, where appropriate, will be carried into the space 10 once again, until they have been gasified completely. Even if these particles remain adhering to the inner wall 119 of the space 10, complete gasification can be expected after some time.

Inasmuch as the particles consist of fully burntout and nongasifiable ash, they may, admittedly, form a coating on the inner wall 119 of the space 10 in course of time. This coating then has to be removed during inspections of the plant. However, on account of the swirl flow in the postcombustion space 10 or on account of its oblique arrangement, these fly ash particles can only in an insignificant proportion pass into the outlet conduit 11 and thus contaminate the downstream heat exchanger.

Altogether, a very long dwell time in the space 10 is obtained for the particles, so that complete postcombustion can be expected or the postcombustion space 10 acts in the manner of a particle trap located upstream of the outlet conduit.

The invention has been described in detail with emphasis on the preferred embodiment thereof, but variations and modifications my occur to those skilled in the art to which the invention pertains from the foregoing specification and the appended claims.

I claim:

1. A furnace system for solid combustible material, the combustible material including organic solid fuels comprising wood, wood waste, bark, biowaste and waste from the production of chipboards and similar materials; said system comprising:

a furnace space having a primary region with various zones including a drying zone, a combustion zone and a burnout zone; a secondary region arranged above the primary region, with an air supply entering the secondary region; and an upwardly extending furnace space outlet arranged above the secondary region from the furnace space; combustion gases being generated in the furnace space;

feed grate means for continuously rearranging the combustible material and guiding the combustible material through the zones of the primary region of said furnace space; and postcombustion space for receiving combustion gases and arranged above said furnace space having walls defining a lower region, an upper end, and a generally cylindrical configuration comprising a swirl chamber with a longitudinal axis inclined relative to a horizontal plane and extending through said upper end, and an upper outlet arranged at said upper end;

wherein said furnace space outlet of said furnace space opens into said lower region of said postcombustion space.

2. The furnace system as claimed in claim 1, wherein said furnace outlet of the furnace space is arranged obliquely relative to the longitudinal axis of the postcombustion space.

3. The furnace system as claimed in claim 1, wherein the postcombustion space comprises a blower assembly means for exciting the combustion gases to a turbulent flow rotating in a swirling manner about the longitudinal axis of the postcombustion space.

4. The furnace system as claimed in claim 1, wherein the longitudinal axis of the postcombustion space is inclined and thereby allows particles from the combustion gases in the postcombustion space to be precipitated onto said walls to slip to said furnace space outlet.

* * * * *

UNITED STATES PATENT AND TRADEMARK OFFICE

CERTIFICATE OF CORRECTION

PATENT NO. : 5,694,868

DATED : December 9, 1997

INVENTOR(S) : Hans Mitthof

It is certified that error appears in the above-indentified patent and that said Letters Patent is hereby corrected as shown below:

Item [73] Assignee: Richard Kablitz & Mitthof GmbH, Germany

Signed and Sealed this

Second Day of June, 1998

*Attest:*

*Attesting Officer*

BRUCE LEHMAN

*Commissioner of Patents and Trademarks*